US005833004A

United States Patent [19]

Coronado

[11] Patent Number: 5,833,004

[45] Date of Patent: Nov. 10, 1998

[54] RUNNING LINERS WITH COILED TUBING

[75] Inventor: Martin P. Coronado, Houston, Tex.

[73] Assignee: Baker Hughes Incorporated, Houston, Tex.

[21] Appl. No.: 960,767

[22] Filed: Oct. 30, 1997

Related U.S. Application Data

[63] Continuation of Ser. No. 589,767, Jan. 22, 1996, abandoned.

[51] Int. Cl.[6] ..... E21B 23/04

[52] U.S. Cl. ..... 166/382; 166/187

[58] Field of Search ..... 166/65.1, 117.5, 166/187, 191, 212, 255.1, 382, 387

[56] References Cited

U.S. PATENT DOCUMENTS

| | | | |
|---|---|---|---|
| 4,619,323 | 10/1986 | Gidley | 166/285 |
| 4,619,326 | 10/1986 | van Mierlo . | |
| 4,848,459 | 7/1989 | Blackwell et al. . | |
| 4,928,759 | 5/1990 | Siegfried, II et al. | 166/65.1 |
| 5,211,715 | 5/1993 | Braden et al. | 166/117.5 X |
| 5,253,705 | 10/1993 | Clary et al. | 166/123 |
| 5,271,461 | 12/1993 | Decker et al. | 166/185 |
| 5,277,255 | 1/1994 | Bell . | |
| 5,343,956 | 9/1994 | Coronado | 166/387 |
| 5,421,414 | 6/1995 | Lane et al. . | |
| 5,454,419 | 10/1995 | Vloedman | 166/277 |
| 5,551,512 | 9/1996 | Smith | 166/212 |

*Primary Examiner*—Frank Tsay
*Attorney, Agent, or Firm*—Rosenblatt & Redano P.C.

[57] ABSTRACT

A method is disclosed which allows running liners with external casing packers on coiled tubing in a single trip. The compact design afforded by being able to support the liner near its lower end adjacent the lowermost external casing packer allows for a combined overall length of running tool and inflation tool short enough to fit into a standard lubricator.

20 Claims, 4 Drawing Sheets

RUNNING LINERS WITH COILED TUBING

This application is a continuation of application Ser. No. 08/589,767 filed on Jan. 22, 1996 now abandoned.

FIELD OF THE INVENTION

The field of this invention relates to running in liners, particularly those with external casing packers on coiled tubing.

BACKGROUND OF THE INVENTION

Frequently, in existing well bores which have perforated casings, a need arises to isolate a particular zone for a variety of reasons such as that it starts to produce water or gas. This is done by straddling such zones with a liner. The liner is a tubular that is insertable in the wellbore that has external casing packers. Once the liner is placed at the desired location where the external casing packers straddle the preexisting perforations, the external casing packers are inflated and the particular zone in question is isolated. Production can then begin or resume from the other zone or zones in the wellbore.

In the past, such liners have been run in with drilling rigs where a running tool is connected to the top of the liner. That tool is coupled through a long piece of tubing to an inflation tool or other type of setting tool which is disposed initially adjacent the lowermost external casing packer. The string is then made up in the usual manner joint-by-joint until the desired depth is reached. The lowermost external casing packer is then inflated or set at which point the running tool can be released and the inflation or setting tool spotted at the next higher external casing packer for its inflation or setting. Ultimately the assembly is removed from the wellbore as the string is picked up and racked up on the rig. This is an extremely time consuming process. A simple substitution of the coiled tubing unit for a rigid tubing string still creates certain logistical problems. Even if a coiled tubing unit is used with a running tool which supports the liner at the top, the running tool must still be attached to the inflation tool by a segment of tubing which at times can be hundreds of feet long. Traditionally, coiled tubing units are used in conjunction with surface-mounted lubricators which are of finite length. The procedure has been to withdraw the tool or tools into a lubricator so that they can be isolated from the wellbore and then ultimately removed while the wellbore is shut-in. However, with the distances involved between a running tool supporting the liner at the top and the inflation tool being potentially hundreds of feet below, it becomes impractical to remove that assembly through a lubricator. Conceivably, a snubbing unit can be employed for piecemeal removal of such components. However, this procedure is cumbersome, time consuming and potentially hazardous. Killing the well in order to accomplish this procedure is also undesirable.

Accordingly, one of the objects of the invention is to provide a simple one-trip system which allows the use of coiled tubing to run liners with external casing packers. It is a further object of the invention to configure the bottom hole assembly such that the running tool and the inflation tool can be easily removed through a lubricator. It is a further object of this invention to provide support for the liner close to its lower end in the area of the lowermost external casing packer such that the assembly connected to the lower end of the coiled tubing is as short as possible and will readily fit into a lubricator. These and other objectives of the invention will become clear upon review of the detailed description which appears below.

SUMMARY OF THE INVENTION

A method is disclosed which allows running liners with external casing packers on coiled tubing in a single trip. The compact design afforded by being able to support the liner near its lower end adjacent the lowermost external casing packer allows for a combined overall length of running tool and inflation tool short enough to fit into a standard lubricator.

DETAILED DESCRIPTION OF THE PREFERRED EMBODIMENT

Figure 1:
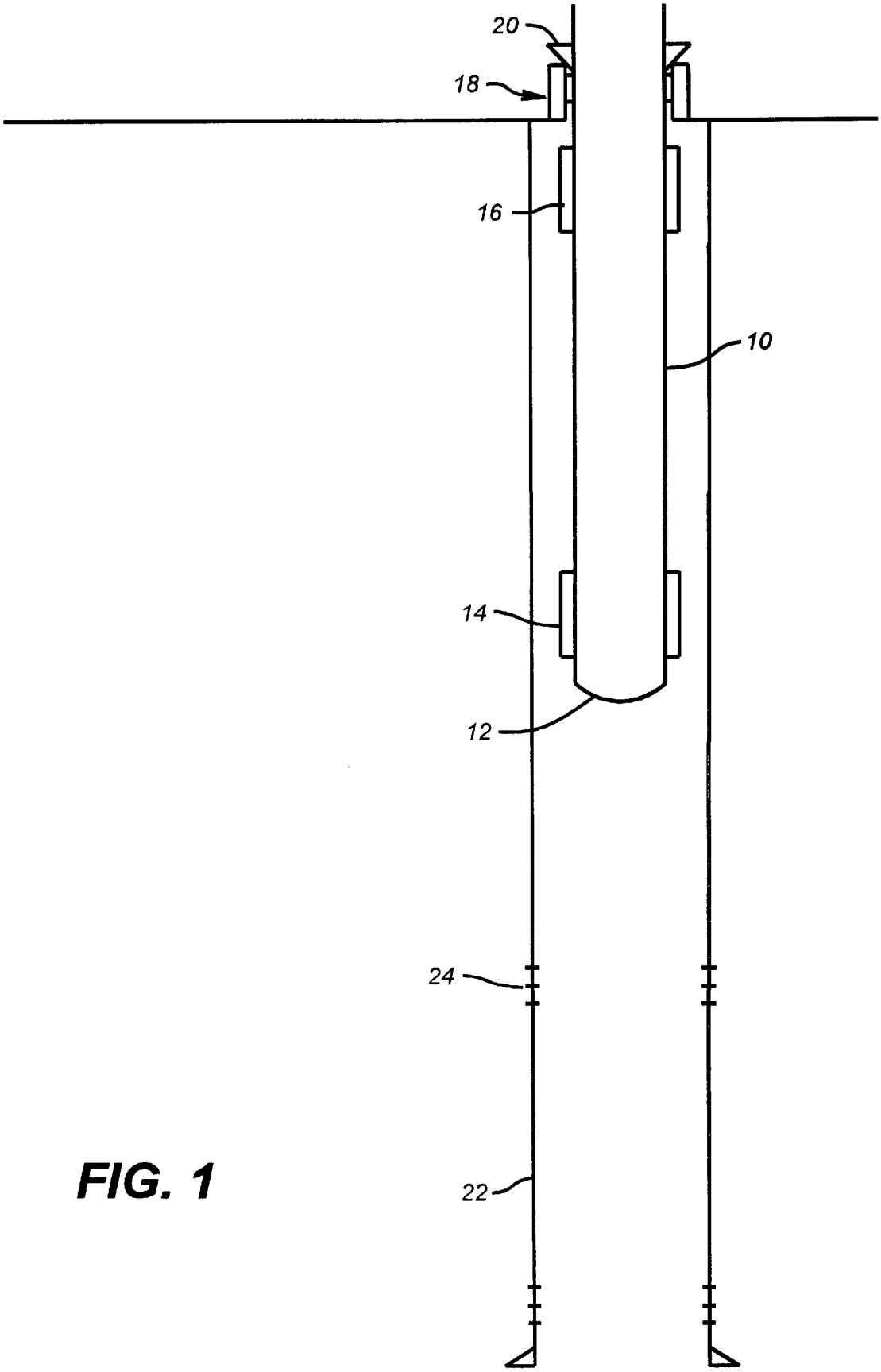
FIG. 1 is a schematic representation of the initial support of the liner prior to attachment of the running tool.

FIG. 1 illustrates schematically temporary support for a liner 10 having a float shoe 12 at the bottom. Float shoe 12 in conjunction with blowout preventers (BOP) 18 keep the well from coming in during the insertion procedure. The liner 10 has a lower external casing packer 14 and an upper external casing packer 16. Although external casing packers are preferred any other type of plug or packer can be used without departing from the spirit of the invention. The liner is inserted through the blowout preventers 18 which are closed around the liner 10. The weight of the liner 10 is supported by slips 20. The existing casing 22 has perforations 24 which ultimately will be straddled by the external casing packers 14 and 16.

Figure 2:
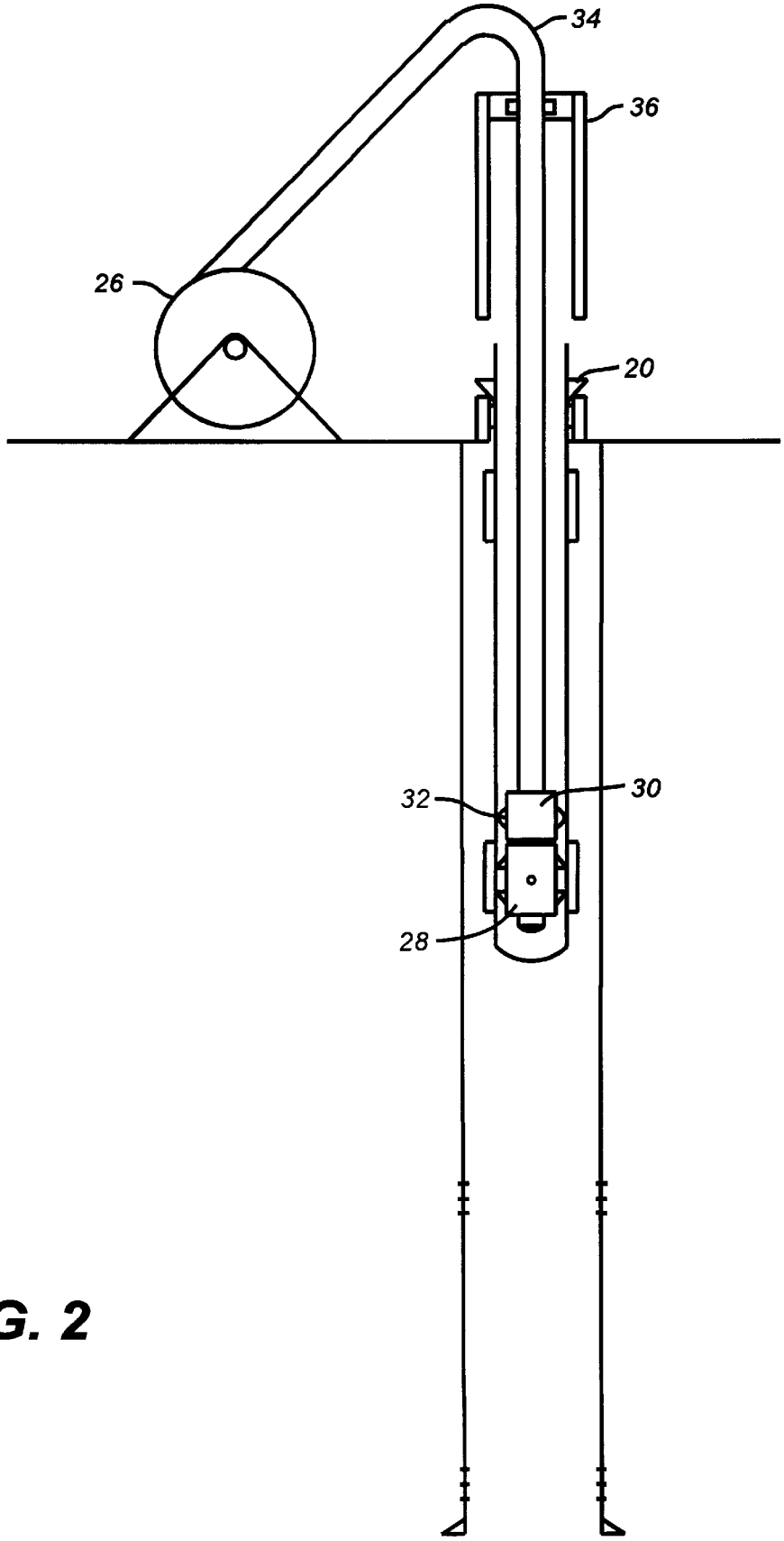
FIG. 2 illustrates the coiled tubing unit with the running tool and inflation tool secured inside the liner.
Figure 3:
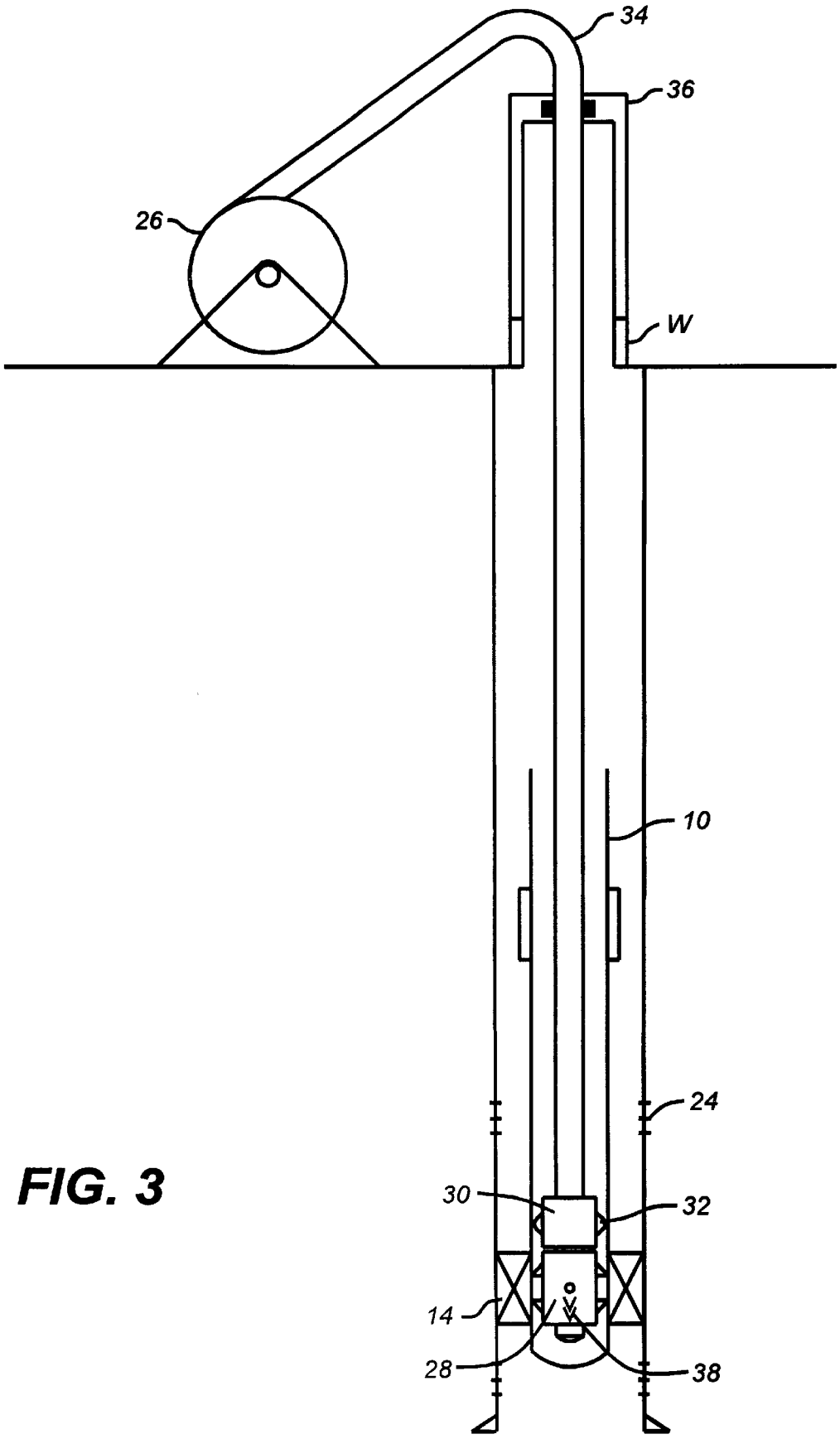
FIG. 3 indicates placement of the liner at the desired depth in the wellbore with the lowermost external casing packer inflated.

Having suspended the liner 10 on the slips 20 a coiled tubing unit 26 is located adjacent the wellbore and an assembly is put together comprising an inflation tool 28 and a liner running tool 30. The liner running tool 30 is attached to a profile adjacent the lower end of the liner 10 adjacent the area of lower external casing packer 14. The liner running tool 30 has projecting members 32 which catch a profile in the liner 10 in the known manner for ultimate support of the entire assembly as seen in FIG. 3. It should be noted that referring to the view of FIG. 2, that the inflation tool 28 and running tool 30 are supported by coiled tubing 34 which runs through a lubricator 36. Thus, in the position of FIG. 2 with the running tool 30 attached to the liner 10 the slips 20 can be removed and the assembly of the running tool 30 and the inflation tool 28 is supported by coiled tubing 34 from the coiled tubing unit 26. Those skilled in the art will appreciate that the inflation tool 28 and the running tool 30 are assembled together in close proximity at the surface and run into the bottom of the liner 10 at which point the running tool 30 catches a profile (not shown) in the liner 10 to shift support of the liner 10 to the coiled tubing 34 from the slips 20. In FIG. 2 the lubricator 36 has not yet been secured to the wellhead. The coiled tubing 34 has been inserted through the lubricator 36 and thereafter the inflation tool 28 and running tool 30 are assembled to the liner 10. While an inflation tool is described other types of tools to actuate the packers 14 and 16 can be used without departing from the spirit of the invention.

The close spacing of running tool 30 and inflation tool 28 so that they may be installed or removed through a lubricator 36 can also be accomplished if the running tool supports the liner 10 near the uppermost external casing packer such as 16 or elsewhere on the liner. If initially supported higher on the liner 10, the packer inflation sequence can be altered to be from top to bottom instead of from bottom to top.

Figure 4:
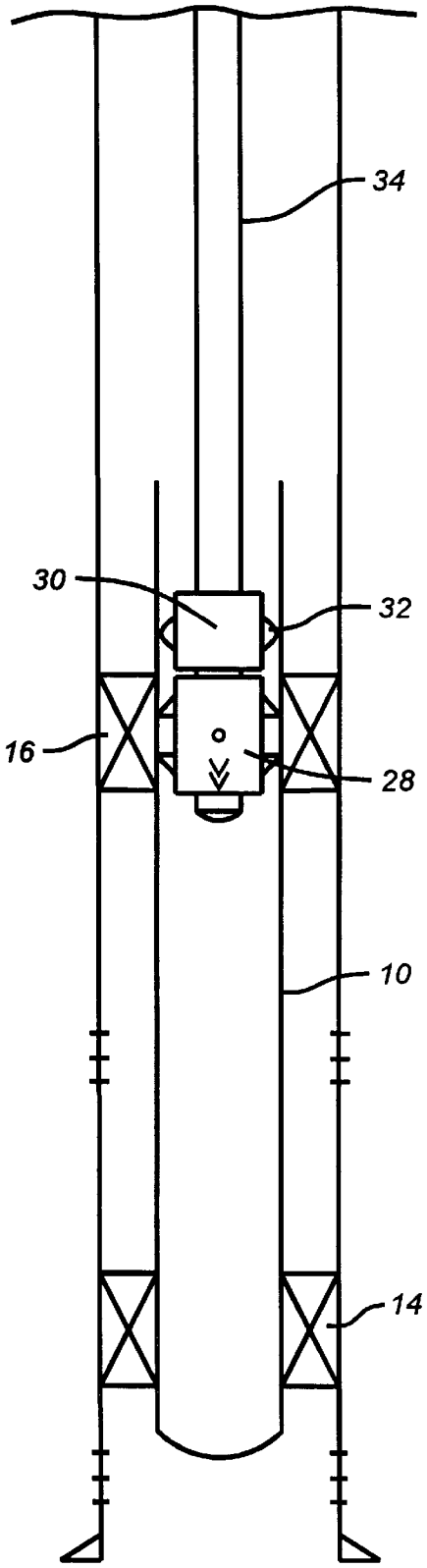
FIG. 4 illustrates the inflation of the upper external casing packer.

Referring now to FIG. 3, the coiled tubing unit 26 is illustrated with coiled tubing 34 supporting the inflation tool 28 and the running tool 30 near the lower end of the liner 10 with the liner 10 now in position so that the lower external casing packer 14 is below openings 24 and has now been inflated preferably with cementitious material. In accomplishing this step, the lubricator 36 which in FIG. 2 is shown suspended above the slips 20 has now been attached to the wellhead with the slips 20 removed. The BOP's 18 have been opened allowing the liner to be lowered to the location shown in FIG. 3. In the traditional manner, a plug 38 is spotted in the inflation tool 28 and the cementitious material is pumped into the lower external casing packer 14 to inflate it. Following the conclusion of the inflation, pressure is applied in the coiled tubing 34 to actuate a release mechanism to allow the projecting members 32 to retract from the profiles in the liner 10 so that the coiled tubing 34 can be hoisted up to place the inflation tool 28 adjacent the upper external casing packer 16 as shown in FIG. 4. When the proper placement is achieved additional cementitious material is pumped into the upper external casing packer 16 to inflate it. FIG. 4 shows the inflated position of both upper and lower external casing packers 14 and 16. The lower external casing packer 14 supports the liner 10 as the coiled tubing 34 brings up the running tool 30 into position so that the inflation tool 28 can inflate the upper external casing packer 16. More than two packers can be used if desired or a single packer that can isolate the zone in question can be used without departing from the spirit of the invention.

Figure 5:
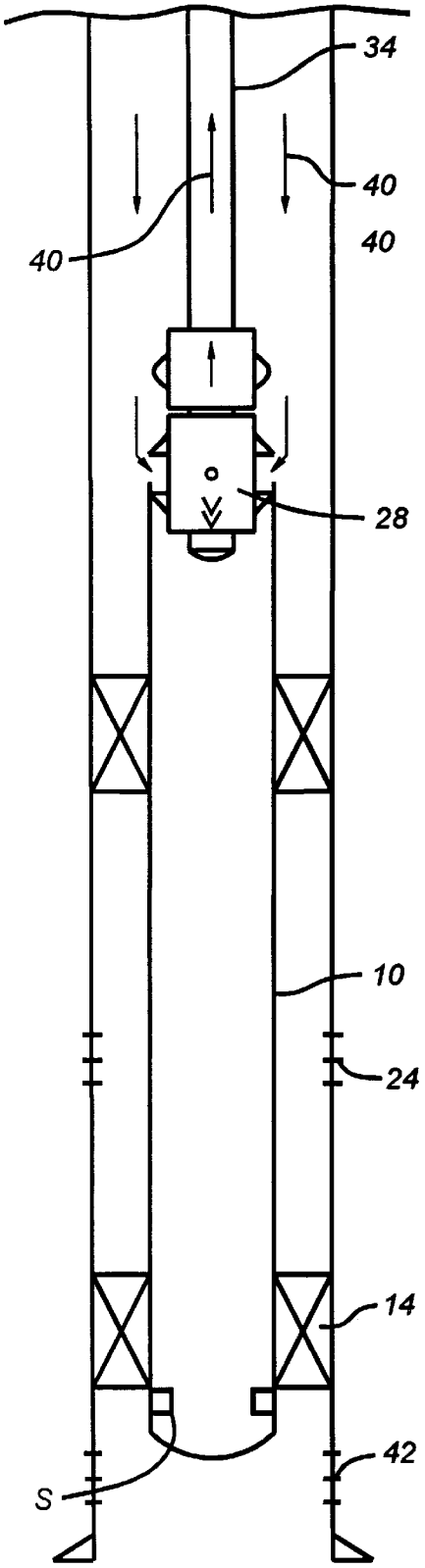
FIG. 5 illustrates retraction of the inflation tool out of the liner to facilitate a reverse circulating procedure to remove excess cement prior to pulling out of the hole with the coiled tubing, the running tool and the inflation tool.

Referring to FIG. 5, the coiled tubing 34 is raised to lift the inflation tool 28 out of the liner 10. The arrows 40 indicate a reverse circulation flowpath so that the excess cement or other material used to inflate the external casing packers 14 and 16 can be reversed out or circulated out of the coiled tubing 34. Thereafter, the coiled tubing 34 along with the inflation tool 28 and the running tool 30 are pulled into the lubricator 36.

It should be noted in FIG. 5 that the liner 10 extends below the lower external casing packer 14. Thus, the zone below the liner 10 reflected in openings 42 can be produced by perforating the liner 10 or opening a sliding sleeve valve in the liner 10, or drilling out the float shoe 12 to provide access to the openings 42.

What has been disclosed is a simple system which allows the use of a coiled tubing unit to run in a liner which has external casing packers and set the external casing packers in a single trip. Additionally, support for the liner 10 adjacent its lower end allows the known running tool 30 to be placed in close proximity to the known inflation tool 28 so that they both may be assembled, installed and removed through a lubricator 36. The use of snubbing units is not required to remove the assembly of the running tool 30 and the inflation tool 28. As distinguished from systems that support the liner 10 from its upper end, the present invention does not require a lengthy space-out tube from the top of the liner to the lowermost external casing packer because the running tool in the present invention is already situated in close proximity to the inflation tool 28. Accordingly, running in and removing the assembly of the running tool 30 with the inflation tool 28 is greatly simplified. A more readily available coiled tubing unit 26 can be employed to run liners, particularly those with external casing packers such as 14 and 16 without the need for a rig. The entire run in and set-up operation can be accomplished more quickly through the use of a coiled tubing unit 26 which does not involve the time required for makeup of a string as would otherwise be necessitated by using rigid tubing and a rig.

The foregoing disclosure and description of the invention are illustrative and explanatory thereof, and various changes in the size, shape and materials, as well as in the details of the illustrated construction, may be made without departing from the spirit of the invention.

I claim:

1. A method of running liners into a wellbore, comprising:

supporting a liner having at least one packer with coiled tubing;

using said coiled tubing to position said liner at a predetermined depth in a wellbore; and setting said packer.

2. The method of claim 1, further comprising:

accomplishing said positioning of said liner and said setting of said packer in a single insertion of said coiled tubing into the wellbore.

3. The method of claim 2, further comprising:

using a running tool mounted adjacent a lower end of said coiled tubing to support said liner.

4. The method of claim 3, further comprising:

mounting a packer setting tool adjacent said running tool.

5. The method of claim 4, further comprising:

positioning said packer setting tool adjacent said packer when said running tool supports said liner.

6. The method of claim 5, further comprising:

inflating said packer with said packer setting tool to support said liner in the wellbore.

7. The method of claim 6, further comprising:

releasing said running tool from the liner after inflation of said packer.

8. The method of claim 7, further comprising:

providing a plurality of packers on said liner;

inflating any uninflated packers.

9. The method of claim 8, further comprising:

removing said inflation tool from said liner; and clearing the coiled tubing of any material used for inflation.

10. The method of claim 9, further comprising:

removing said running tool and inflation tool by manipulation of said coiled tubing through a lubricator.

11. The method of claim 4, further comprising:

inserting said packer setting tool and said running tool by manipulation of said coiled tubing through a lubricator.

12. A method of running a liner in a wellbore, comprising:

supporting the liner with coiled tubing adjacent the lower end of said liner;

providing an external support on said liner;

running the liner into the wellbore; and supporting the liner in the wellbore with said external support.

13. A method of running a liner in a wellbore, comprising:

supporting the liner with coiled tubing adjacent the lower end of said liner;

running the liner into the wellbore; and supporting the liner in the wellbore; and providing at least one external packer mounted to the liner to support the liner in the wellbore.

14. The method of claim 13, further comprising:

using a running tool mounted to the coiled tubing to internally support the liner; and closely mounting an inflation tool to the running tool.

15. The method of claim 14, further comprising:

inserting the combined running and inflation tool with coiled tubing through a lubricator.

16. The method of claim 15, further comprising:

providing a plurality of packers on said liner;

setting all said packers in one insertion of said coiled tubing; and releasing said running tool from the liner.

17. The method of claim 16, further comprising:

setting said packers with inflation material through the coiled tubing;

circulating or reverse circulating out said inflation material from the coiled tubing.

18. The method of claim 17, further comprising:

removing the assembly of said running tool and said inflation tool from the wellbore through a lubricator.

19. The method of claim 8, further comprising:

inflating said packers in order starting from the deepest packer on the liner in the wellbore to the shallowest packer in the wellbore.

20. The method of claim 8, further comprising:

inflating said packers in order starting from the shallowest packer in the wellbore to the deepest packer on the liner in the wellbore.

* * * * *